United States Patent [19]

Klygis et al.

[11] 4,009,805

[45] Mar. 1, 1977

[54] POUR SPOUT

[75] Inventors: Mindaugas Julius Klygis, Barrington; William Norfred Weaver, Glen Ellyn, both of Ill.

[73] Assignee: Illinois Tool Works Inc., Chicago, Ill.

[22] Filed: Mar. 29, 1976

[21] Appl. No.: 671,512

[52] U.S. Cl. ..... 222/530; 222/567

[51] Int. Cl.[2] ..... B67D 5/06

[58] Field of Search ..... 222/570, 566, 558, 567, 222/538, 530; 141/337, 338

[56] References Cited

UNITED STATES PATENTS

| | | | |
|---|---|---|---|
| 952,313 | 3/1910 | Droz | 141/337 X |
| 1,929,295 | 5/1934 | Van Deerlin et al. | 222/538 |
| 2,353,521 | 7/1944 | Steffens | 222/530 |

*Primary Examiner*—Stanley H. Tollberg
*Assistant Examiner*—Hadd Lane
*Attorney, Agent, or Firm*—E. L. Benno; R. W. Beart

[57] ABSTRACT

A plastic pouring spout including a container engaging body portion with a spout portion projecting therefrom and adapted for mounting in juxtaposition to the outer surface of a container within the end confines of the container in retracted position and slidable along the container to a position with the spout portion extended beyond the adjacent end of the container; and in which extended position, the opposite elongate edges of the spout portion may be brought together relative to one another by partial separation from the remnant container engaging body portion adjacent the container end surface to reduce the size of the spout portion for pouring of the container contents into a relatively smaller recipient orifice.

16 Claims, 4 Drawing Figures

POUR SPOUT

BACKGROUND AND SUMMARY OF THE INVENTION

This invention relates to pouring spouts for attachment to containers, particularly cans having outward peripheral end beads or chimes, such that, in the non-use or retracted position, the spout is disposed within the end beads of a container in surface juxtaposition with the container body surface and at least partially encircling the same in snug but slidable attachment therewith so as to offer no interference to the packaging of plural such containers in various forms of cartons or other carrier means. For this purpose, the individual spouts are formed from an unsupported sheet of resilient and elastic plastic material, such as high density polyethylene, and include a band-like portion to snugly engage the container body and a spout portion of generally truncate or trapezoidal form projecting therefrom and along the surface of the container. After a container is opened for dispensing the contents, the band-like body portion may be easily slid along the container to position the spout for directing the contents to a recipient orifice. An example of such spouts for attachment to containers is shown in U.S. Pat. No. 3,726,447 to Klygis.

With such spout arrangements, the spout will substantially follow its container associated configuration, though troughed, when in extended position for pouring. In some instances, such a spout configuration will not be small enough for pouring into a relatively small recipient orifice, as for example, the transmission oil filler pipe for an automobile transmission, without spillage; and too, such filler pipes are often rather inaccessible and could be better serviced with some permissive manipulation of the reduced size pouring spout.

With the above in mind, one of the principle objects of the present invention is to provide a spout generally of the above type for slidable attachment to the outer surface of a container and wherein the spout may be reduced in size in the pouring position to facilitate pouring into relatively small recipient orifices without spillage.

Another object of the invention is to provide a spout of the above type wherein the opposite longitudinal edge portions of the spout portion may be partially severed from the remnant band-like body portion permitting the same to be brought together and secured in the reduced size spout portion.

A further object of the invention is to provide a spout of the above type wherein the remnant connection with the body portion provides a hinge area permitting the reduced spout portion to be angled relative to the associated container to facilitate pouring in inaccessible spaces.

The above and other objects of the invention will in part be obvious and will be hereinafter more fully pointed out in the description of the drawings.

DESCRIPTION OF THE DISCLOSURE

Figure 1:
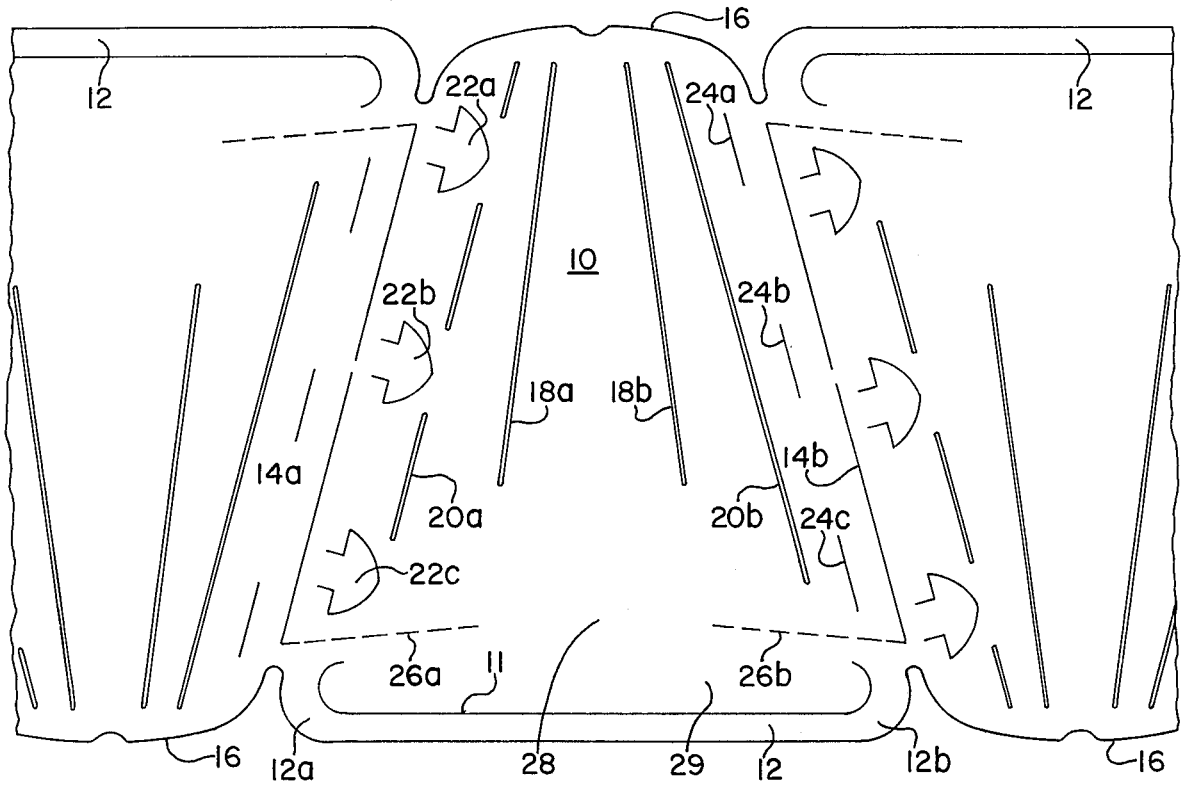
FIG. 1 is a fragmentary plan view of a strip or sheet of plastic material from which individual pouring spouts are formed.

With reference to FIG. 1, individual spouts may be formed from a continuous strip or web of the plastic material with the generally trapezoidal or truncate shape of each spout permitting base-to-tip alignment of side-by-side spouts in the plastic web or strip. Each spout, such as the center spout blank 10 in FIG. 1, presents a wider base portion which includes an integral band 12 having opposite rounded edges with the band being defined by a slit or cut 11 in the plastic material also terminating in rounded ends to define the rounded edge portions **12*a*, 12*b* of the band. When separated from the web or strip, each spout includes opposite side marginal edges 14*a*, 14*b* tapering toward one another from the edge portions 12*a*, 12*b*, respectively, to an apposite narrower and transversely curved tip portion 16. The width of the base portion is selected in accordance with the periphery of the container with which the spout is to be associated such that when the band 12 is drawn away from the remainder 29 of the body portion, the combined extent of both will define a container engaging area with the resiliency of the plastic material assuring snug juxtaposed engagement with the surface of the container. In like manner, the angle of convergence of the side marginal edges 14*a*, 14*b***, and the length will be selected in accordance with the height and peripheral extent of the container such that the spout, when applied to the container, is no longer than the container body such that the opposite ends of the spout will be within and confined by the container end beads or chimes against accidental axial displacement in retracted position; and this same selection of relative dimensions is such that with the spout in extended position, the spout body will assume a trough or V-shaped configuration with the side walls decreasing to the pouring tip portion.

Within the marginal edges **14*a*, 14*b* of the spout blank 10, the material of the blank is scored or otherwise deformed as by coining, in lengthwise direction to provide an inner pair of score lines 18*a*, 18*b* and an outer pair of such lines 20*a*, 20*b* extending from adjacent the tip portion 16 toward the opposite wider edge of the blank. The lines 20*a*, 20*b* are generally parallel to the marginal edges 14*a*, 14*b*, respectively, and the lines 18*a*, 18*b* extend at a somewhat variant angle to diverge a lesser amount than the outer score lines and to terminate short of the ends thereof. Between the marginal edge 14*a* and the score line 20*a*, there are provided tabs with anchor-like hook ends 22*a*, 22*b*, 22*c* illustrated as being three in number but the number may vary and a single hook, such as the intermediate hook 22*b* will be sufficient in many instances. The hooks are formed by slitting the spout material leaving an attachment or hinge base portion, and the continuity of the score line 20*a* may be interrupted along the extent of the hooks 22*a*, 22*b*. Within the opposite marginal edge 14*b*, there are provided longitudinal slits 24*a*, 24*b*, 24*c*** spaced in accordance with the hooks 22a, 22b, 22 c, respectively, for interengaged cooperation therewith when folding the spout material along the score lines to reduce the size of the spout. Here again, the number of slits will correspond to the number of hooks. Adjacent the curved end portions 12a, 12b of the band or strap 12, the spout blank is provided with inwardly directed tear lines 26a, 26b which are inclined slightly inwardly relative to the cut line 11 and with the inner ends thereof spaced from one another to opposite sides of the center line of the blank to leave therebetween an area 28 which may serve as a hinge or fold area as will be hereinafter pointed out.

Figure 2:
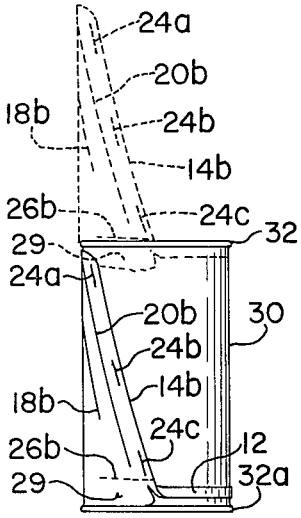
FIG. 2 is a side elevation of a container with a spout applied thereto in the retracted full line position and in the extended dotted line position.

With reference to FIG. 2, there is shown a container 30 of conventional can type having outward end beads or chimes 32, 32a, with the spout 10 of FIG. 1 associated therewith in full line retracted position and in broken line extended position. Thus, in retracted position, the strap 12 engages the container slightly above the bottom chime 32a with the remnant wider portion 29 within the cut line 11 and the included tear lines engaging the remainder of the container wall within the chime 32a. The opposite narrow end 16 of the spout will be snugged below the upper chime 32. In the extended position, the strap portion 12 will snug beneath the upper chime 32 with the tear lines 26a, 26b located adjacent the chime 32. In this extended position, spout may be used for pouring without reducing the size as by severing along the tear lines and attaching the hooks through the slits 24a, 24b, 24c for this purpose, but this would be for installations with sufficient accessibility and a large enough opening into which the contents may be poured. However, in installations with limited accessibility and with relatively small recipient openings, the spout is constructed so that it may be reduced in size as will be pointed out immediately hereinafter.

Figure 3:
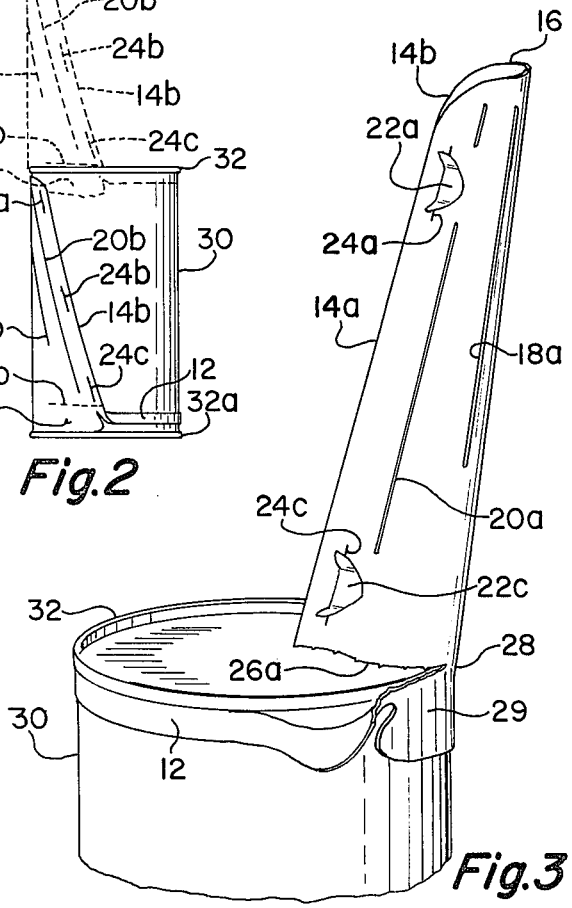
FIG. 3 is a fragmentary perspective view showing the spout in extended position relative to an associated container and with the opposite edge portions of the spout secured together by a pair of hook and slit connections in a reduced size for pouring.
Figure 4:
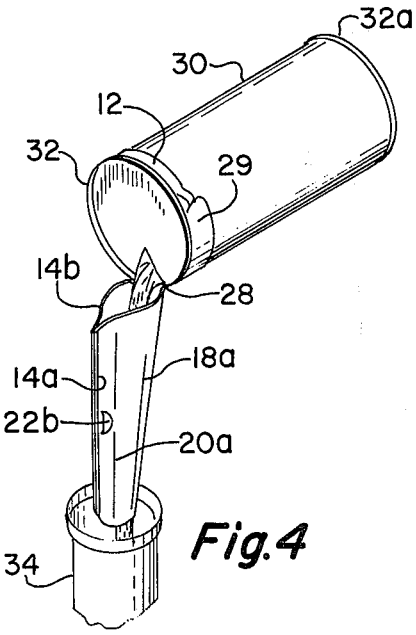
FIG. 4 is a perspective view showing the reduced size spout with a single hook and slit connection, angled relative to the associated container for pouring therefrom into a relatively small recipient orifice as of a transmission filler pipe.

With reference to FIG. 3, the side marginal portions of the spout have been severed along the tear lines 26a, 26b and brought together to a trough or generally U-shaped configuration as defined by the fold or coined lines 18a, 18b, 20a, 20b, with the marginal edges 14a, 14b held together or in close adjacency by only two anchor hooks 22a, 22c inserted through corresponding slits 24a, 24c, respectively. The fold or coined lines will tend to maintain the longitudinal integrity of the spout in this trough shape for pouring into a relatively small size opening which is readily accessible so that the spout need not be angularly folded along the hinge area 28. However, where the opening to be filled is somewhat inaccessible, as in some oil filler tubes and in many transmission oil filler pipes, the container 30 may be located and held in a position approaching the horizontal as shown in FIG. 4. In such position, the spout can be angularly turned about the hinge area 28 to depend from the container for entry of the small end 16 thereof into the relatively small opening of a transmission oil filler tube 34, for instance as shown also in FIG. 4. The feasability of employing one anchor hook and slit connection 22b, 24b, respectively, is also illustrated. With such a single hook and slit connection, the score or coined lines maintain the lengthwise integrity of the spout while permitting the collapsing thereof for attachment of the anchor hook with the slit with the spout in trough or U-shape through which the container contents may be poured from the punched opening in the container to the relatively small filler tube opening.

We claim:

1. A spout formed from a sheet of flexible material and adapted for attachment to a complementary container; and comprising a body of generally trapezoidal shape with opposite marginal edges tapering between the smaller and wider end portions to define a pouring spout with the wider end portion including a transverse strip portion and an adjacent transverse remnant body portion adapted for permissive relative partial separation to provide a band combination for encircling an associated container body for permissive sliding therealong from retracted position with the band combination and spout portion within the ends of a container body to extended position with the spout portion projecting beyond an adjacent end of a container for permissive drawing together of the marginal edges, and interengageable attachment means adjacent opposite marginal edges for holding the said edges in inwardly drawn position reducing the size of the pouring spout at least toward the pouring exit end portion.

2. A spout as claimed in claim 1, wherein tear lines extend inwardly toward one another from opposite marginal edges adjacent the remnant body portion for permissive separation therealong between the spout portion and the remnant body and drawing together of the marginal edges for reducing the size of the spout portion along the length thereof including the pouring exit.

3. A spout as claimed in claim 1, wherein at least one fold line extends lengthwise along the spout portion and within the marginal edges to facilitate drawing together of the marginal edges in reducing the size of the spout exit.

4. A spout as claimed in claim 3, wherein tear lines extend inwardly toward one another from opposite marginal edges adjacent the remnant body portion for permissive separation therealong between the spout portion and the remnant body portion and drawing together of the marginal edges for reducing the size of the spout portion along the length thereof including the pouring exit.

5. A spout as claimed in claim 4, wherein there are paired fold lines facilitating troughing of the spout portion as the marginal edges are drawn together and with the remnant body portion between the inner ends of the tear lines providing a hinge area for permissive angular positioning of the spout portion relative to the band combination when assembled to a container.

6. A spout formed from a sheet of flexible material and adapted for attachment to a complementary container; and comprising a body of generally trapezoidal shape with opposite marginal edges tapering between the smaller and wider end portions to provide a pouring spout with the wider end portion including a transverse strap portion and an adjacent transverse remnant body portion adapted for permissive relative partial separation to provide a band combination for encircling an associated container body for permissive sliding therealong from retracted position with the band combination and spout portion within the ends of a container body to extended position with the spout portion projecting beyond an adjacent end of a container, and tear lines extending inwardly toward one another from opposite marginal edges adjacent the remnant body portion for permissive separation therealong between the spout portion and the remnant body portion and inwardly drawing together of the marginal edges for reducing the size of the spout portion along the length thereof when projected beyond the end of an associated container.

7. A spout as claimed in claim 6, wherein there are provided spaced fold lines generally along the length of the spout portion between the tear lines and the smaller end portion and along which fold lines the spout portion may be creased to provide longitudinal integrity to the reduced trough shape of the spout portion.

8. A spout as claimed in claim 7, wherein interengageable attachment means are provided adjacent opposite marginal edges for holding said marginal edges in inwardly drawn position reducing the size of the pouring spout.

9. A spout as claimed in claim 6, wherein interengageable attachment means are provided adjacent opposite marginal edges for holding said marginal edges in inwardly drawn position reducing the size of the pouring spout.

10. A spout as claimed in claim 9, wherein said attachment means comprises at least one set of interengageable anchor hook and slit means adjacent respective marginal edges.

11. The combination of a one-piece spout for mounting on the outer surface of a complementary container wherein said spout is comprised of a flat blank of flexible sheet material of generally trapezoidal shape having converging side margins with end portions of differing lengths, the broader end of said blank provided with a slit which defines a band integral with said blank and when deflected out of the plane of said blank presenting with said blank an opening to accept the complementary container in gripping encircling relation, the narrow end of said blank providing a tip portion to said spout, the spout device being storable on said complementary container when said broader end of said blank is in the vicinity of one end of the container with the remaining blank of the spout encircling the container body, the tip portion being capable of being extended beyond the other end of the container as the spot is moved relative to the container body to provide a pouring surface formed generally to the configuration of the outer surface of the container and presenting a concave surface to facilitate pouring of the contents of the container in a controlled manner, and interengageable attachment means formed in the side margins of said spout for alternatively holding the side margins of said spout together to provide a substantially conical surface to facilitate pouring of the contents of the container over a reduced area.

12. In combination with a container body portion with opposite ends through one of which the contents are to be dispensed; the provision of a spout assembly formed from a sheet of flexible material providing a spout body portion between side marginal edges extending from one end of the sheet toward the opposite end thereof and having a band formation at said opposite end of the sheet embracingly encircling the container body portion and slidable therealong from an inoperative position with the spout assembly within the ends of the container body portion and in trough conformation to the surface configuration thereof to an operative dispensing position with the spout body portion extending beyond the adjacent end of the container body portion, tear lines extending inwardly toward one another from the side marginal edges of the sheet in position to be located generally in line with the said adjacent end of the container body portion when the spout assembly is in operative dispensing position for tearing therealong to separate adjacent edges of the spout body portion and band formation and collapse the marginal edges of the spout portion toward one another reducing the size of the trough conformation of the spout body portion, and means tending to maintain the reduced size of the trough conformation for pouring the contents from the container into a relatively small recipient opening.

13. The combination as set forth in claim 12, wherein the means tending to maintain the reduced size of the trough conformation comprises score lines along the length of the spout body portion for creasing the spout body portion therealong.

14. The combination as set forth in claim 13, wherein there are provided interengageable attachment means adjacent opposite marginal edges of the spout body portion for holding the said edges in trough size reducing position.

15. The combination as set forth in claim 12, wherein the means tending to maintain the reduced size of the trough conformation comprises interengageable attachment means adjacent opposite marginal edges of the spout body portion for holding said edges in trough size reducing position.

16. The combination as set forth in claim 15, wherein the spout body portion between the inner ends of the tear lines provides a hinge area for directing the reduced size spout portion at selected angles from the adjacent end of the container body portion for dispensing of the contents into relatively inaccessible recipient openings.

* * * * *